United States Patent [19]

Guerriero

[11] Patent Number: 4,517,065

[45] Date of Patent: May 14, 1985

[54] ALLOYED-LEAD CORROSION-RESISTING ANODE

[75] Inventor: Renato Guerriero, Mestre, Italy

[73] Assignee: SAMIN Societe Azionaria Minero-Metallurgicia S.p.A., Rome, Italy

[21] Appl. No.: 556,558

[22] Filed: Nov. 30, 1983

Related U.S. Application Data

[62] Division of Ser. No. 311,613, Oct. 15, 1981.

[30] Foreign Application Priority Data

Oct. 20, 1980 [IT] Italy ..... 25458 A/80

[51] Int. Cl.[3] ..... C25C 1/14

[52] U.S. Cl. ..... 204/119; 204/105 R; 204/114; 204/293

[58] Field of Search ..... 204/293, 105 R, 114, 204/119

[56] References Cited

U.S. PATENT DOCUMENTS 4,364,807 12/1982 von Ropenack ..... 204/119

4,373,654 2/1983 Prengaman ..... 204/293

*Primary Examiner*—John F. Niebling

*Attorney, Agent, or Firm*—Hedman, Gibson, Costigan & Hoare

[57] ABSTRACT

A corrosion-resisting anode made of a planar sheet of alloyed lead, to be used in industrial cells wherein acidic solutions are circulated, for the electrowinning of non-ferrous metals, such as zinc and cadmium, is characterized in that it is composed by 98.9 to 99.9% of lead, from 0.1 to 1% calcium and from 0 to 0.1% silver.

7 Claims, No Drawings

ALLOYED-LEAD CORROSION-RESISTING ANODE

This is a division of application Ser. No. 311,613 filed Oct. 15, 1981.

This invention relates to the use of a corrosion-resisting anode, made of a planar sheet of alloyed lead, to be used in industrial cells in which acidic solutions flow for the electrowinning of non-ferrous metals (Zn, Cd and the like).

It is known that, in the industrial electrolytic cells intended for the production of metals by electrolysis, for example for the production of zinc, and the anodes must possess the following properties:

- the planar sheets must possess an adequate stiffness to prevent deformations, and an appropriate hardness to minimize the mechanical erosion;
- such anodes must be virtually immune from attack by the acidic solutions fed to the electrolytic cells, add,
- the anode-forming material must not contain any impurities susceptible of polluting the electrolyte and thus the final product, that is the cathodic deposit or of lowering the faradic and energetic efficiency of the electrolysis.

The material which is conventionally used is a binary lead and silver alloy having a silver content variable from 1% to 0.75%. This alloy can be cast in standard planar form having the required dimensions, or it can be cast in slabs and then rolled in order to obtain planar sheets having the desired thickness, to be subsequently severed in the desired size. No matter how they have been obtained, the plates are then welded to the bus data (lead-coated copper bars).

Summing up, the Pb-Ag alloy is the immersed portion of the conventional anodes in direct contact with the circulating electrolyte (active anode) and has the mechanical and physicochemical specifications indicated hereinabove.

For every 100 kg of Pb-Ag alloy there are used from 0.75 kg to 1.00 kg of pure silver. The average service life of an anode is two years, whereafter it is replaced since it has lost about one half of its weight, and remelted to produce a fresh alloy. More particularly, the silver which can directly be recovered is but one half of the quantity which had been used originally.

It has now been found that a possibility exists of partially (or totally) replacing silver with another alloying metal, which is cheaper, while maintaining (and improving) the mechanical and physico-chemical properties of the anode while avoiding any pollution of the electrolyte, that is, by providing a pure cathodic deposit and a satisfactory faradic and energetic efficiency for the cell.

More particularly, it has been ascertained that the use of calcium, alloyed with small values of other elements, for example, silver itself, originates a ternary alloy which can be converted into anodes with the methods outlined above: these anodes, as a result of field tests, have proven to be as valid of the conventional Pb-Ag anodes, if not better, inasmuch as they have the same mechanical properties, the same faradic and energetic cell efficiency, the same resistance to corrosion, the same or a reduced pollution of the cathodes, and the same or a longer service life, as compared with the hitherto conventional anodes.

It has been found that the cost of an anode thus produced is by 20%–25% less than the cost of a conventional anode, on taking into account that the present price of silver is in constant increase relative to that of lead. A composition which is particularly advantageous for the anode according to the present invention has a lead content of from 98.9% to 99.9%, a calcium content of from 0.1% to 1%, and a silver content of from 0% to 0.1% on a weight basis.

By way of example without any limitation, a few data of the performances of experimental cells for electrolysis of zinc-containing solutions will be given hereunder, the compositions of the anodes being as follows:

ANODE TYPE No. 1 - conventional anodes (Pb 99.15% - Ag 0.85%) ANODE TYPE No. 2 - low-Ag anodes (Pb 99.9% - Ag 0.10%) ANODE TYPE No. 3 - Ca-only alloyed anodes (Pb 99.5% - Ca 0.5%) ANODE TYPE No. 4 - Ca-Ag-alloyed anodes (Pb 99.4% - Ca 0.5% - Ag 0.1%)

The operational parameters of the cells were, for all the tested anodes:

current density 450 A/sq. m
Zn g/liter 65
$H_2SO_4$ g/liter 122
Glue g/liter 0.005

The test results are:

| ANODE TYPE N°. | 1 | 2 | 3 | 4 |
|---|---|---|---|---|
| Pb in the produced cathodes, % | 0.0024 | 0.010 | 0.010 | 0.0022 |
| Pb in the solution discharged from the cells, g/liter | 0.0013 | 0.0033 | 0.0033 | 0.0013 |

I claim:

1. A method for the electrowinning of a non-ferrous metal, said method comprising subjecting an acidic solution containing said non-ferrous metal to an electric current in an electrolytic cell in which the anode is composed of from 98.9% to 99.9% of lead, from 0.1% to 1% calcium and 0% to 0.1% silver, on a weight basis, and thereafter recovering said non-ferrous metal.

2. A method as defined in claim 1 wherein the anode is composed of from 98.9% to 99.9% lead, from 0.1% to 1% calcium and 0.1% silver.

3. A method as defined in claim 1 wherein the anode is comprised of 99.5% lead and 0.5% calcium.

4. A method as defined in claim 1 wherein the anode is composed of 99.4% lead, 0.5% calcium and 0.1% silver, by weight.

5. A method as defined in claim 1 wherein the non-ferrous metal is selected from the group consisting of zinc and cadmium.

6. A method as defined in claim 5 wherein the acidic solution comprises zinc and sulfuric acid.

7. A method for the electrowinning of a non-ferrous metal, said method consisting essentially of subjecting an acidic solution containing said non-ferrous metal to an electric current in a electrolytic cell in which the anode consists of 99.4% lead, 0.5% calcium and 0.1% silver by weight.

* * * * *